US009441343B2

(12) United States Patent
Abe et al.

(10) Patent No.: US 9,441,343 B2
(45) Date of Patent: Sep. 13, 2016

(54) WORK VEHICLE AND OPERATOR PROTECTIVE GUARD

(71) Applicant: KOMATSU LTD., Tokyo (JP)

(72) Inventors: Hiroshi Abe, Hirakata (JP); Makoto Sasaki, Takatsuki (JP)

(73) Assignee: KOMATSU LTD., Tokyo (JP)

( * ) Notice: Subject to any disclaimer, the term of this patent is extended or adjusted under 35 U.S.C. 154(b) by 29 days.

(21) Appl. No.: 14/422,234

(22) PCT Filed: Dec. 11, 2014

(86) PCT No.: PCT/JP2014/082783

§ 371 (c)(1),
(2) Date: Feb. 18, 2015

(87) PCT Pub. No.: WO2015/087950

PCT Pub. Date: Jun. 18, 2015

(65) Prior Publication Data

US 2016/0168824 A1 Jun. 16, 2016

(51) Int. Cl.
*B60N 99/00* (2006.01)
*E02F 9/16* (2006.01)

(52) U.S. Cl.
CPC ..... *E02F 9/163* (2013.01)

(58) Field of Classification Search
CPC ..... E02F 9/163
See application file for complete search history.

(56) References Cited

U.S. PATENT DOCUMENTS 6,810,980 B2 * 11/2004 Jo ..... B60R 21/11 180/89.13
2003/0111281 A1 6/2003 Jo et al.
2014/0292032 A1 10/2014 Sasaki et al.
2015/0123428 A1 5/2015 Hwang

FOREIGN PATENT DOCUMENTS

| | | | |
|---|---|---|---|
| CN | 1426916 | A | 7/2003 |
| CN | 202627058 | U | 12/2012 |
| DE | 10239724 | A1 | 12/2013 |
| JP | H06-087457 | U | 12/1994 |
| JP | 2001-097250 | A | 4/2001 |
| JP | 2002-194773 | A | 7/2002 |
| JP | 2003-191812 | A | 7/2003 |
| JP | 2013-181317 | A | 9/2013 |
| JP | 5355831 | B1 | 11/2013 |
| WO | WO 2011-025874 | A1 | 3/2011 |
| WO | WO 2013/191308 | A1 | 12/2013 |

* cited by examiner

*Primary Examiner* — Lori L Lyjak
(74) *Attorney, Agent, or Firm* — Drinker Biddle & Reath LLP

(57) ABSTRACT

Provided is a work vehicle capable of expanding a field of vision from inside a cab equipped with an operator protective guard. A front guard provided on a front side of a cab has a frame constituting an outer edge of the front guard. The frame is formed by framing an upper frame, a lower frame, a right vertical frame, and a left vertical frame. The right vertical frame has a vertical frame bent portion, and extends rearward toward the cab as it comes close to the lower frame from the vertical frame bent portion.

7 Claims, 12 Drawing Sheets

(a)

(b)

WORK VEHICLE AND OPERATOR PROTECTIVE GUARD

TECHNICAL FIELD

The present invention relates to a work vehicle and an operator protective guard.

BACKGROUND ART

A work vehicle such as a hydraulic excavator or a scrap loader includes a cab in which an operator operating the work vehicle rides. The cab is equipped with an operator protective guard for appropriately protecting the operator against vandals flying from the front of or above the cab to the cab.

A conventional operator protective guard is disclosed, for example, in Japanese Patent No. 5355831 (PTD 1). In a front guard disclosed in this document, plate members intersecting with one another in vertical and horizontal directions are arranged radially about an eye point of an operator, so as not to obstruct a field of vision of the operator sitting inside a cab.

CITATION LIST

Patent Document

PTD 1: Japanese Patent No. 5355831

SUMMARY OF INVENTION

Technical Problem in the front guard disclosed in Japanese Patent No. 5355831 (PTD 1), a field of vision from an operator seat is ensured by arranging each of the plate-like members combined in a grid pattern to be parallel to a line of vision of the operator. However, a guard-equipped cab equipped with an operator protective guard is required to have further improved field of vision from the operator seat inside the cab. The structure of the conventional operator protective guard is not necessarily sufficient, and there is still room for improvement.

An object of the present invention is to provide a work vehicle capable of expanding a field of vision from inside a cab equipped with an operator protective guard, and the operator protective guard.

Solution to Problem

A work vehicle in accordance with the present invention includes a work implement, a cab arranged on a lateral side of the work implement, and an operator protective guard provided on a front side of the cab. The operator protective guard includes a frame body constituting an outer edge of the operator protective guard. The frame body includes an upper frame, a lower frame, a right vertical frame, and a left vertical frame. The frame body is formed by framing the upper frame, the lower frame, the right vertical frame, and the left vertical frame. One of the right vertical frame and the left vertical frame which is closer to the work implement includes a vertical frame bent portion, and extends rearward toward the cab as the one vertical frame comes close to the lower frame from the vertical frame bent portion.

In the above work vehicle, the upper frame is formed of a plate material.

In the above work vehicle, the upper frame includes widened portions at both ends, and includes a narrowed portion narrower than the widened portions at a central portion.

In the above work vehicle, the lower frame, the right vertical frame, and the left vertical frame are formed of a pipe.

In the above work vehicle, the one of the right vertical frame and the left vertical frame which is closer to the work implement is provided with a plurality of mounting portions mounting the operator protective guard on the cab. The one vertical frame includes a lower end portion coupled to the lower frame. The vertical frame bent portion is formed at a position closer to the lower end portion than a lowermost one of the mounting portions.

In the above work vehicle, the mounting portions each include a hinge structure. The operator protective guard relatively rotates with respect to the cab, about the hinge structures.

In the above work vehicle, the lower frame includes a lower frame bent portion. The lower frame extends rearward toward the cab as the lower frame comes close to the one of the right vertical frame and the left vertical frame which is closer to the work implement from the lower frame bent portion.

An operator protective guard in accordance with the present invention is an operator protective guard provided on a front side of a cab of a work machine, including a frame body constituting an outer edge of the operator protective guard. The frame body includes an upper frame, a lower frame, a right vertical frame, and a left vertical frame. The upper frame is formed of a plate material. The lower frame, the right vertical frame, and the left vertical frame are formed of a pipe. At least one of the right vertical frame and the left vertical frame includes a vertical frame bent portion.

Advantageous Effects of Invention

According to the present invention, a work vehicle capable of expanding a field of vision from inside a cab equipped with an operator protective guard can be achieved.

DESCRIPTION OF EMBODIMENTS

Hereinafter, embodiments of the present invention will be described with reference to the drawings.

(First Embodiment)

First, a configuration of a work vehicle in one embodiment of the present invention will be described. Although a hydraulic excavator as one example of a work vehicle to which the concept of the present invention is applicable will be described below, the present invention is applicable to a work vehicle including a cab.

Figure 1:
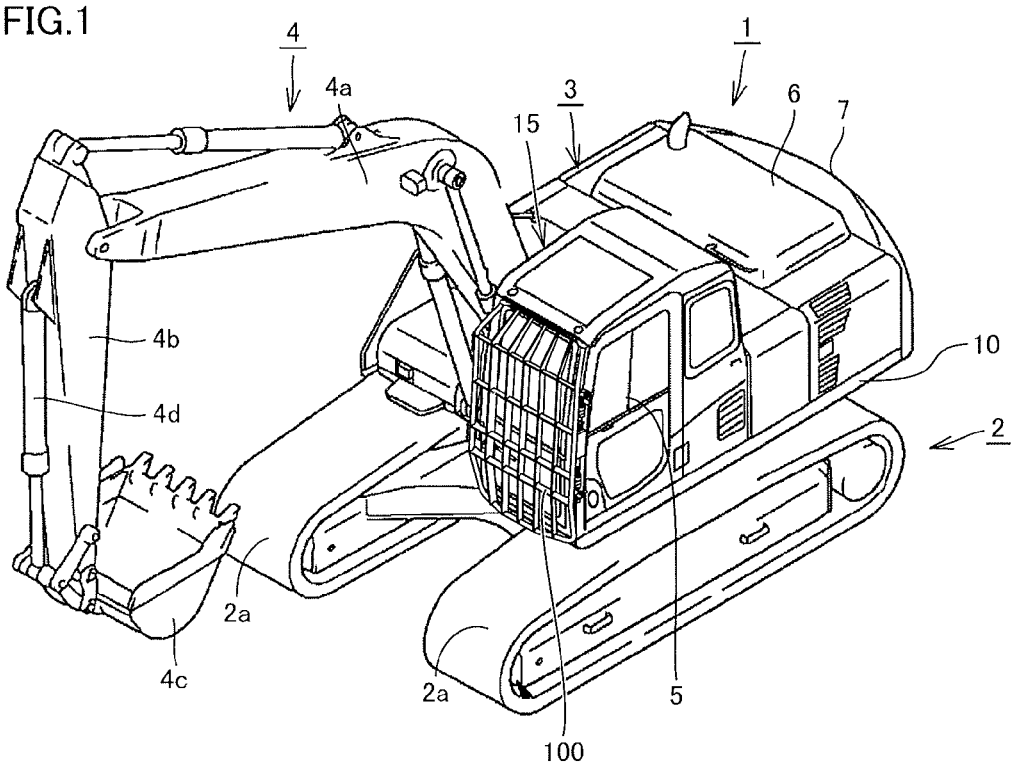
FIG. 1 is a perspective view schematically showing a configuration of a work vehicle in a first embodiment of the present invention.

FIG. 1 is a perspective view schematically showing a configuration of a hydraulic excavator 1 as a work vehicle in a first embodiment of the present invention. As shown in FIG. 1, hydraulic excavator 1 mainly includes a travel structure 2, a revolving structure 3, a work implement 4, and a guard-equipped cab 15. Travel structure 2 and revolving structure 3 mainly constitute a main body of the work vehicle.

Travel structure 2 has a pair of right and left crawler belts 2*a*. Travel structure 2 is configured to allow self-propelling by rotating the pair of crawler belts 2*a*. Revolving structure 3 is mounted revolvably with respect to travel structure 2.

Revolving structure 3 includes a cab 5 as a space for an operator to operate hydraulic excavator 1, on a front left side. Revolving structure 3 includes an engine compartment 6 accommodating an engine, and a counterweight 7, on a rear side. It is noted that, in the present embodiment, with the operator sitting inside cab 5, a front side of the operator is defined as a front side of revolving structure 3, a side opposite to the front side, that is, a rear side of the operator, is defined as a rear side of revolving structure 3, a left side of the sitting operator is defined as a left side of revolving structure 3, and a right side of the sitting operator is defined as a right side of revolving structure 3. It is hereinafter assumed that the front, rear, left, and right of revolving structure 3 correspond to the front, rear, left, and right of the work vehicle.

Revolving structure 3 includes a revolving frame 10. Revolving frame 10 is included in the main body of the work vehicle. Revolving frame 10 is arranged above travel structure 2, and is provided to be revolvable in an arbitrary direction with respect to travel structure 2. Work implement 4, guard-equipped cab 15, and counterweight 7 are mounted on revolving frame 10 and arranged on an upper surface of revolving frame 10.

Work implement 4 for performing work such as soil excavation is pivotally supported by revolving structure 3 to be operable in an up-down direction. Work implement 4 has a boom 4*a* mounted to a substantially central portion of the front side of revolving structure 3 to be operable upward/downward, an arm 4*b* mounted to a distal end portion of boom 4*a* to be operable forward/rearward, and a bucket 4*c* mounted to a distal end portion of arm 4*b* to be operable forward/rearward. Boom 4*a*, arm 4*b*, and bucket 4*c* are each configured to be actuated by hydraulic cylinders 4*d*.

Guard-equipped cab 15 is arranged on the front left side of revolving structure 3. Work implement 4 is provided on the right side with respect to guard-equipped cab 15, which is one of the lateral sides of guard-equipped cab 15.

Figure 2:
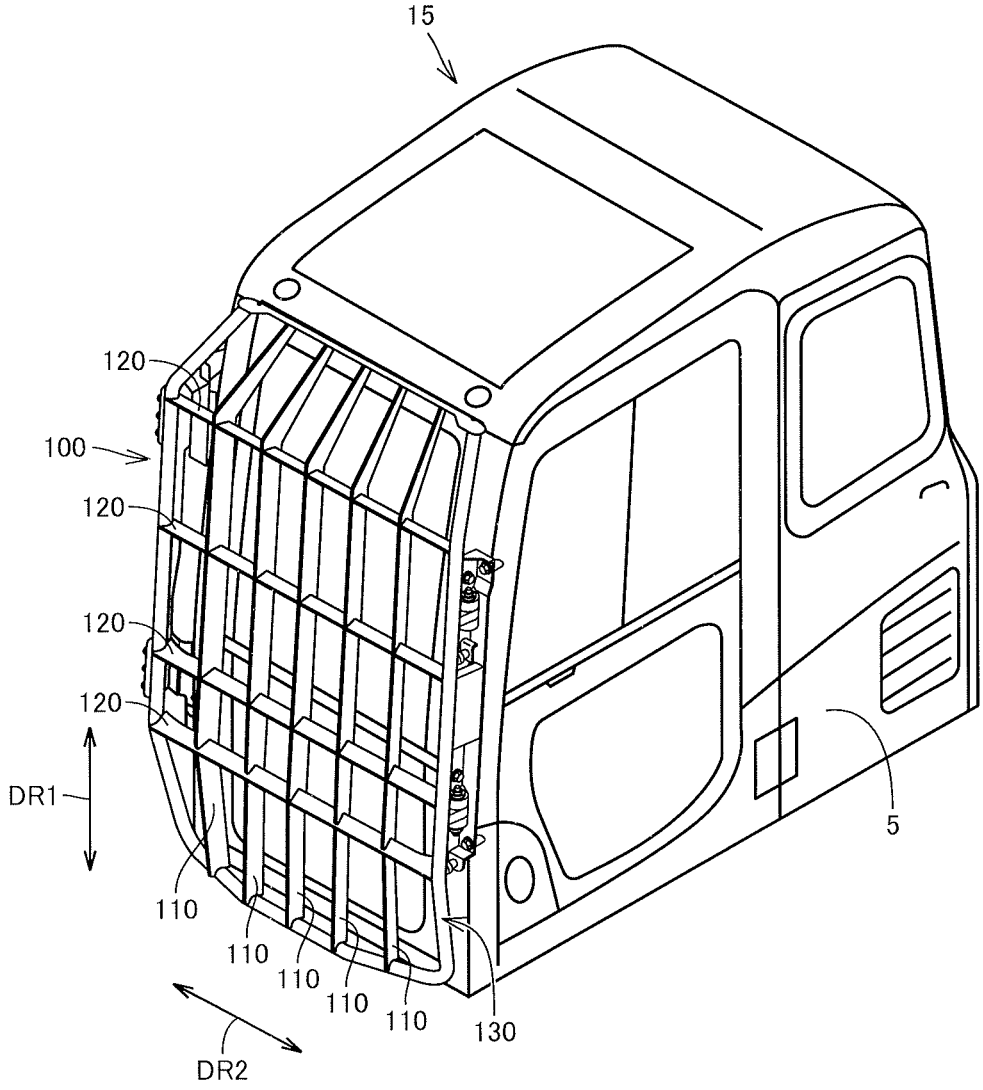
FIG. 2 is a perspective view schematically showing a configuration of a guard-equipped cab in the first embodiment of the present invention.

FIG. 2 is a perspective view schematically showing a configuration of guard-equipped cab 15 in the first embodiment of the present invention. As shown in FIG. 2, guard-equipped cab 15 includes cab 5 in which the operator operating hydraulic excavator 1 rides, and an operator protective guard protecting the operator. The operator protective guard includes a front guard 100. Front guard 100 is mounted on cab 5. Front guard 100 is provided on a front side of cab 5 for the purpose of protecting the operator against flying vandals from the front of cab 5.

Front guard 100 includes a plurality of first plate members 110 and a plurality of second plate members 120. Each first plate member 110 is formed of one plate. Each second plate member 120 is formed of one plate. Front guard 100 has a configuration in which the plurality of first plate members 110 and the plurality of second plate members 120 are assembled in a grid pattern such that a longitudinal direction DR1 of each of the plurality of first plate members 110 intersects with a longitudinal direction DR2 of each of the plurality of second plate members 120.

A frame 130 as a frame body is provided to surround a grid formed by the plurality of first plate members 110 and the plurality of second plate members 120. The periphery of the grid is supported by frame 130. Front guard 100 includes frame 130 surrounding the plurality of first plate members 110 and the plurality of second plate members 120 assembled in the grid pattern. Frame 130 constitutes an outer edge of front guard 100. The plurality of first plate members 110 and the plurality of second plate members 120 are mounted on a surface on the front side of cab 5, with frame 130 interposed therebetween.

Figure 3:
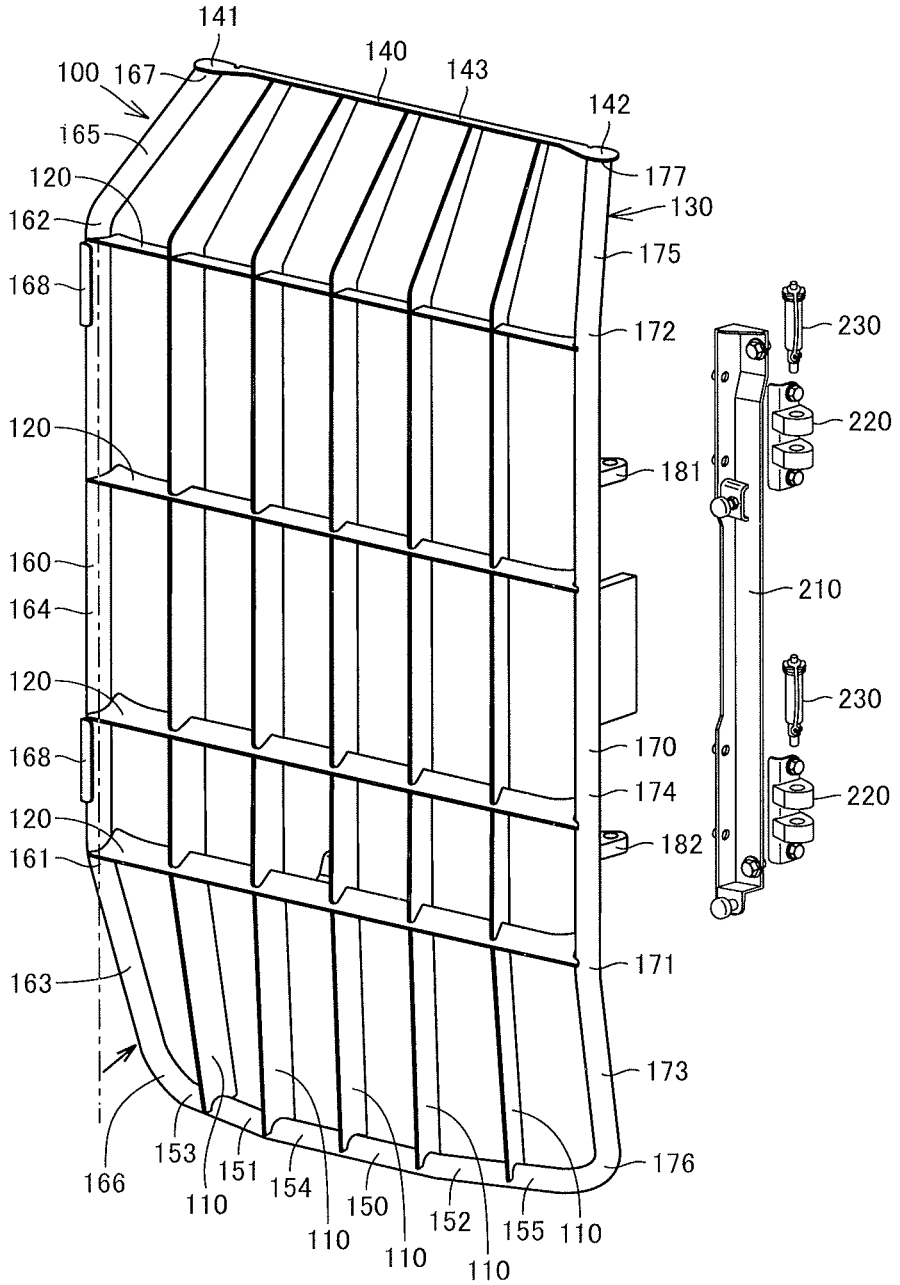
FIG. 3 is a first perspective view schematically showing a configuration of a front guard in the first embodiment of the present invention.
Figure 4:
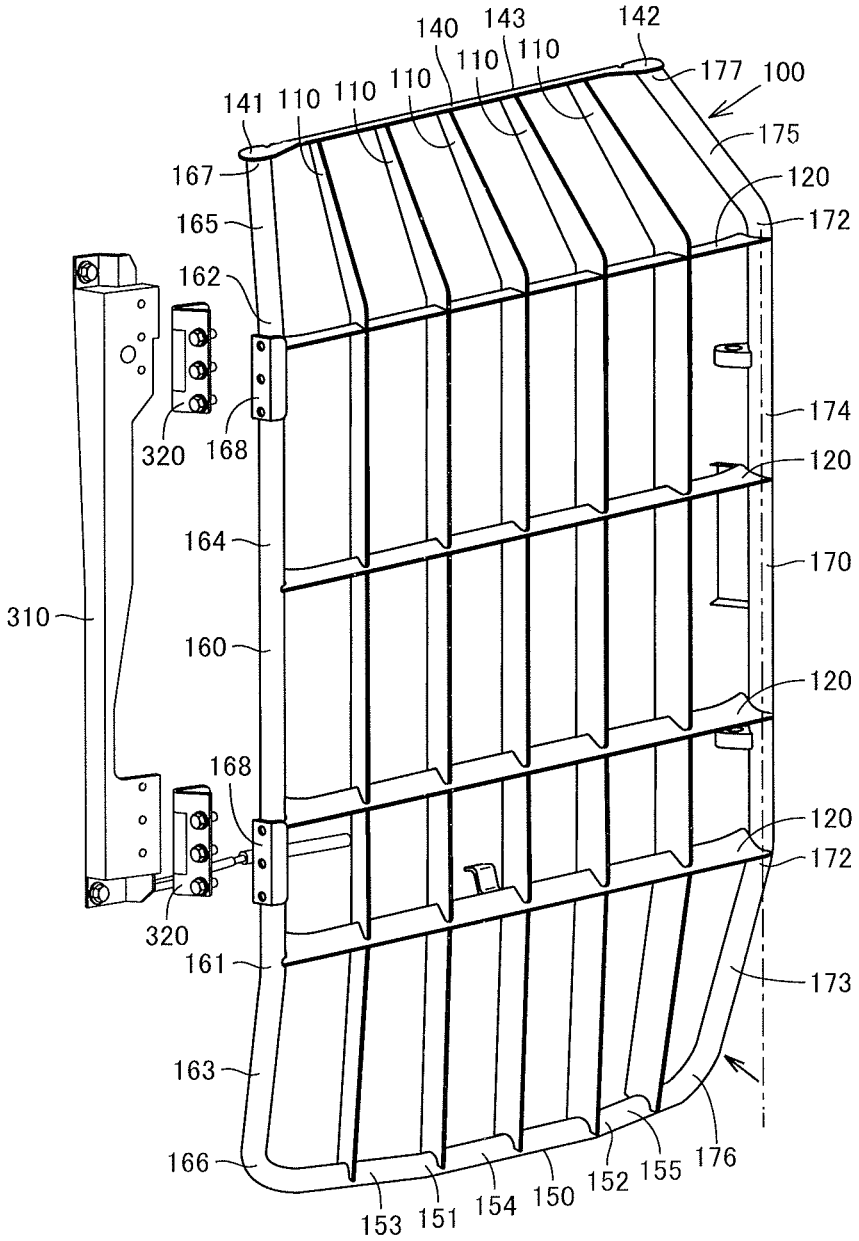
FIG. 4 is a second perspective view schematically showing the configuration of the front guard in the first embodiment of the present invention.

FIG. 3 is a first perspective view schematically showing a configuration of front guard 100 in the first embodiment of the present invention. FIG. 4 is a second perspective view schematically showing the configuration of front guard 100 in the first embodiment of the present invention.

As shown in FIGS. 3 and 4, frame 130 of front guard 100 has an upper frame 140, a lower frame 150, a right vertical frame 160, and a left vertical frame 170. Frame 130 is formed by framing upper frame 140, lower frame 150, right vertical frame 160, and left vertical frame 170.

Lower frame 150, right vertical frame 160, and left vertical frame 170 are formed by bending and deforming a pipe into a predetermined shape and coupling the pipe to each other as appropriate. Upper frame 140 is formed of a plate material. As described later in detail, upper frame 140 has, at both ends, widened portions 141, 142 that are relatively wide, and has, at a central portion, a narrowed portion 143 that is relatively narrow.

Lower frame 150 has a right frame portion 153, a central frame portion 154, and a left frame portion 155. Lower frame 150 has lower frame bent portions 151, 152. Lower frame bent portion 151 is provided at a coupling portion between right frame portion 153 and central frame portion 154. Lower frame bent portion 152 is provided at a coupling portion between left frame portion 155 and central frame portion 154.

Lower frame 150 has a shape bent at lower frame bent portion 151 and lower frame bent portion 152. A direction in which right frame portion 153 extends and a direction in which central frame portion 154 extends intersect with each other. A direction in which left frame portion 155 extends and the direction in which central frame portion 154 extends intersect with each other.

Front guard 100 in the present embodiment has five first plate members 110. Lower frame bent portion 151 is provided on the right side of the second first plate member 110 from the right. Lower frame bent portion 152 is provided on the left side of the second first plate member 110 from the left.

Right vertical frame 160 has a lower frame portion 163, a central frame portion 164, and an upper frame portion 165. Right vertical frame 160 has vertical frame bent portions 161, 162. Vertical frame bent portion 161 is provided at a coupling portion between lower frame portion 163 and central frame portion 164. Vertical frame bent portion 162 is provided at a coupling portion between upper frame portion 165 and central frame portion 164.

Right vertical frame 160 has a shape bent at vertical frame bent portion 161 and vertical frame bent portion 162. A direction in which lower frame portion 163 extends and a direction in which central frame portion 164 extends intersect with each other. A direction in which upper frame portion 165 extends and the direction in which central frame portion 164 extends intersect with each other.

Front guard 100 in the present embodiment has four second plate members 120. Vertical frame bent portion 161 is provided on a lower side with respect to lowermost second plate member 120. Vertical frame bent portion 162 is provided on an upper side with respect to uppermost second plate member 120.

Right vertical frame 160 has a lower end portion 166 and an upper end portion 167. At lower end portion 166, right vertical frame 160 is coupled to lower frame 150. At upper end portion 167, right vertical frame 160 is coupled to upper frame 140.

Lower frame portion 163 of right vertical frame 160 extends rearward toward cab 5 as it comes close to lower frame 150 from vertical frame bent portion 161. At vertical frame bent portion 161, right vertical frame 160 is bent in a direction in which lower end portion 166 coupled to lower frame 150 comes close to cab 5. With guard-equipped cab 15 mounted on revolving frame 10, lower end portion 166 of right vertical frame 160 is arranged to be closer to the rear side of revolving structure 3 than vertical frame bent portion 161.

Upper frame portion 165 of right vertical frame 160 extends rearward toward cab 5 as it comes close to upper frame 140 from vertical frame bent portion 162. At vertical frame bent portion 162, right vertical frame 160 is bent in a direction in which upper end portion 167 coupled to upper frame 140 comes close to cab 5. With guard-equipped cab 15 mounted on revolving frame 10, upper end portion 167 of right vertical frame 160 is arranged to be closer to the rear side of revolving structure 3 than vertical frame bent portion 162.

Lower frame portion 163 of right vertical frame 160 and upper frame portion 165 of right vertical frame 160 are bent in the same direction with respect to central frame portion 164. An alternate long and short dash line shown in FIG. 3 indicates a direction in which central frame portion 164 extends, and an arrow shown in FIG. 3 indicates a direction in which lower frame portion 163 is bent with respect to the direction in which central frame portion 164 extends.

As shown in FIG. 4, central frame portion 164 of right vertical frame 160 is provided with bolt attachment portions 168 at two positions. Two bolt attachment portions 168 are arranged to be spaced from each other in a direction in which right vertical frame 160 extends.

Vertical frame bent portion 161 is formed on the lower end portion 166 side with respect to one of two bolt attachment portions 168 which is closer to lower end portion 166. Vertical frame bent portion 161 is formed at a position closer to lower end portion 166 than lowermost bolt attachment portion 168. Vertical frame bent portion 162 is formed on the upper end portion 167 side with respect to one of two bolt attachment portions 168 which is closer to upper end portion 167. Vertical frame bent portion 162 is formed at a position closer to upper end portion 167 than uppermost bolt attachment portion 168.

A hinge portion 320 is fixed to each bolt attachment portion 168. Hinge portion 320 is fixed to front guard 100 by bolts penetrating hinge portion 320 and being fixed to bolt attachment portion 168.

Hinge portion 320 is also fixed to a bracket 310. Hinge portion 320 is fixed to bracket 310 by bolts penetrating hinge portion 320 and being fixed to bracket 310. Bracket 310 is mounted on a front surface of a right front pillar of cab 5. Front guard 100 is mounted on cab 5 with bracket 310 and hinge portions 320 interposed therebetween.

Bracket 310, hinge portion 320, and bolt attachment portion 168 constitute a mounting portion which mounts front guard 100 on cab 5 in an openable/closable manner. A plurality of mounting portions are provided, since bolt attachment portions 168 are provided to right vertical frame 160 at two positions. Front guard 100 is provided to be able to relatively rotate with respect to cab 5, about hinge portions 320.

Since right vertical frame 160 has a bent shape, a gap is formed between central frame portion 164 of right vertical frame 160 and a front surface of cab 5. The mounting portions for mounting front guard 100 on cab 5 are arranged in this gap. Right vertical frame 160 has a shape bent at two vertical frame bent portions 161, 162, such that the mounting portions can be placed between central frame portion 164 of right vertical frame 160 and cab 5, and lower end portion 166 and upper end portion 167 of right vertical frame 160 are arranged close to the front surface of cab 5. The both end portions of right vertical frame 160 are arranged at positions closer to the front surface of cab 5 than central frame portion 164.

Left vertical frame 170 has a lower frame portion 173, a central frame portion 174, and an upper frame portion 175. Left vertical frame 170 has vertical frame bent portions 171, 172. Vertical frame bent portion 171 is provided at a coupling portion between lower frame portion 173 and central frame portion 174. Vertical frame bent portion 172 is provided at a coupling portion between upper frame portion 175 and central frame portion 174.

Left vertical frame 170 has a shape bent at vertical frame bent portion 171 and vertical frame bent portion 172. A direction in which lower frame portion 173 extends and a direction in which central frame portion 174 extends intersect with each other. A direction in which upper frame portion 175 extends and the direction in which central frame portion 174 extends intersect with each other.

Vertical frame bent portion 171 is provided on a lower side with respect to lowermost second plate member 120. Vertical frame bent portion 172 is provided on an upper side with respect to uppermost second plate member 120.

Left vertical frame 170 has a lower end portion 176 and an upper end portion 177. At lower end portion 176, left vertical frame 170 is coupled to lower frame 150. At upper end portion 177, left vertical frame 170 is coupled to upper frame 140.

Lower frame portion 173 of left vertical frame 170 extends rearward toward cab 5 as it comes close to lower frame 150 from vertical frame bent portion 171. At vertical frame bent portion 171, left vertical frame 170 is bent in a direction in which lower end portion 176 coupled to lower frame 150 comes close to cab 5. With guard-equipped cab 15 mounted on revolving frame 10, lower end portion 176 of left vertical frame 170 is arranged to be closer to the rear side of revolving structure 3 than vertical frame bent portion 171.

Upper frame portion 175 of left vertical frame 170 extends rearward toward cab 5 as it comes close to upper frame 140 from vertical frame bent portion 172. At vertical frame bent portion 172, left vertical frame 170 is bent in a direction in which upper end portion 177 coupled to upper frame 140 comes close to cab 5. With guard-equipped cab 15 mounted on revolving frame 10, upper end portion 177 of left vertical frame 170 is arranged to be closer to the rear side of revolving structure 3 than vertical frame bent portion 172.

Lower frame portion 173 of left vertical frame 170 and upper frame portion 175 of left vertical frame 170 are bent in the same direction with respect to central frame portion 174. An alternate long and short dash line shown in FIG. 4 indicates a direction in which central frame portion 174 extends, and an arrow shown in FIG. 4 indicates a direction in which lower frame portion 173 is bent with respect to the direction in which central frame portion 174 extends.

As shown in FIG. 3, central frame portion 174 of left vertical frame 170 is provided with pin insertion portions 181, 182. Pin insertion portions 181, 182 are arranged to be spaced from each other in a direction in which left vertical frame 170 extends.

Vertical frame bent portion 171 is formed on the lower end portion 176 side with respect to pin insertion portion 182 which is closer to lower end portion 176, of two pin insertion portions 181, 182. Vertical frame bent portion 171 is formed at a position closer to lower end portion 176 than lowermost pin insertion portion 182. Vertical frame bent portion 172 is formed on the upper end portion 177 side with respect to pin insertion portion 181 which is closer to upper end portion 177, of two pin insertion portions 181, 182. Vertical frame bent portion 172 is formed at a position closer to upper end portion 177 than uppermost pin insertion portion 181.

A bracket 210 is mounted on a front surface of a left front pillar of cab 5. Pin stop portions 220 are fixed to bracket 210. Each pin stop portion 220 is fixed to bracket 210 by bolts penetrating pin stop portion 220 and being fixed to bracket 210.

Pin insertion portions 181, 182 are fixed to bracket 210 by arranging pins 230 such that each pin penetrates both pin stop portion 220 and pin insertion portion 181, 182 with each pin insertion portion 181, 182 being combined with pin stop portion 220. Front guard 100 is assembled to cab 5 with bracket 210 and pin stop portions 220 interposed therebetween.

By integrally fixing each pin insertion portion 181, 182 and pin stop portion 220 using pin 230, front guard 100 is assembled to cab 5, and movement of front guard 100 with respect to cab 5 is restricted.

By removing pins 230 from pin insertion portions 181, 182 and pin stop portions 220, restriction of the movement of front guard 100 with respect to cab 5 is canceled. On this occasion, left vertical frame 170 of front guard 100 can relatively move with respect to cab 5, whereas right vertical frame 160 remains mounted on the right front pillar of cab 5 via hinge portions 320. By removing pins 230, front guard 100 is rotatable about hinge portions 320. Thereby, front guard 100 is openable/closeable with respect to the front surface of cab 5.

Bracket 210, pin stop portion 220, and pin insertion portion 181, 182 constitute a lock device which locks front guard 100 in a closed state. A plurality of lock devices are provided, since pin insertion portion 181 and pin insertion portion 182 are provided to left vertical frame 170 at two positions.

Since left vertical frame 170 has a bent shape, a gap is formed between central frame portion 174 of left vertical frame 170 and the front surface of cab 5. The lock devices for locking front guard 100 in a closed state are arranged in this gap. Left vertical frame 170 has a shape bent at two vertical frame bent portions 171, 172, such that the lock devices can be placed between central frame portion 174 of left vertical frame 170 and cab 5, and lower end portion 176 and upper end portion 177 of left vertical frame 170 are arranged close to the front surface of cab 5. The both end portions of left vertical frame 170 are arranged at positions closer to the front surface of cab 5 than central frame portion 174.

Figure 5:
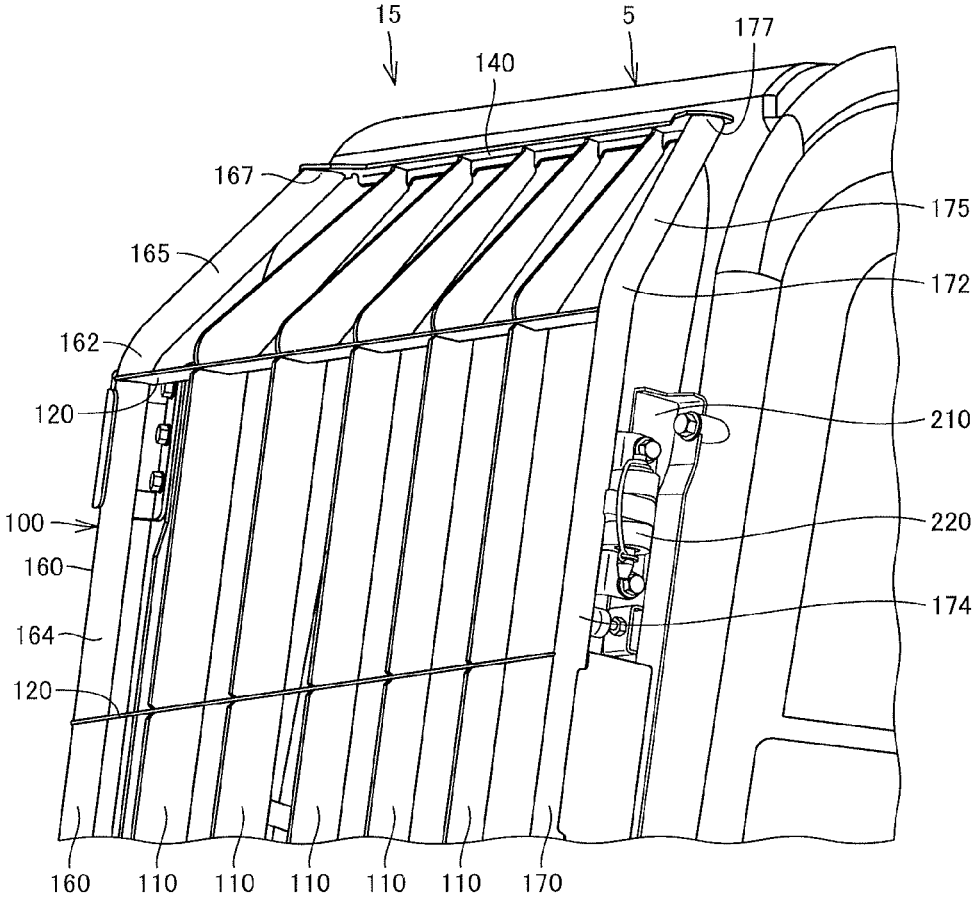
FIG. 5 is a perspective view showing a structure of the guard-equipped cab near an upper frame of the front guard.
Figure 6:
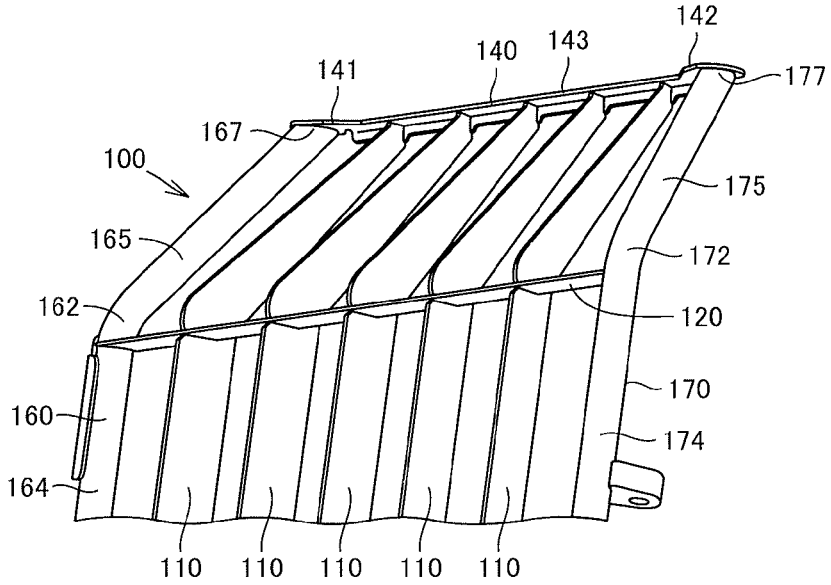
FIG. 6 is a perspective view showing a structure near the upper frame of the front guard.
Figure 7:
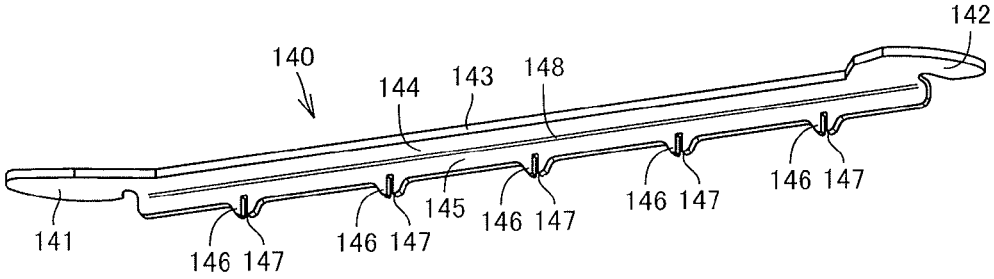
FIG. 7 is a perspective view of the upper frame of the front guard.

FIG. 5 is a perspective view showing a structure of guard-equipped cab 15 near upper frame 140 of front guard 100. FIG. 6 is a perspective view showing a structure near upper frame 140 of front guard 100. FIG. 7 is a perspective view of upper frame 140 of front guard 100.

As shown in FIGS. 5 to 7, upper frame 140 of front guard 100 is formed of a plate material. Upper frame 140 has a first plate portion 144 and a second plate portion 145. Second plate portion 145 is formed to be bent with respect to first plate portion 144. Upper frame 140 is in the shape of an elongate plate having a bent portion 148.

First plate portion 144 of upper frame 140 has widened portions 141, 142 at both ends, and has narrowed portion 143 narrower than widened portions 141, 142 at a central portion. Second plate portion 145 has a plurality of protrusions 146 protruding from an edge of the plate. A slit 147 is formed in each protrusion 146. Protrusions 146 and slits 147 are provided in the same number as the number of first plate members 110 of front guard 100.

An upper end portion of each first plate member 110 is arranged within slit 147. Upper end portion 167 of right vertical frame 160 is joined to widened portion 141. Upper end portion 177 of left vertical frame 170 is joined to widened portion 142. Upper end portion 167 of right vertical frame 160 and widened portion 141 are integrally fixed by welding, for example. Upper end portion 177 of left vertical frame 170 and widened portion 142 are integrally fixed by welding, for example.

First plate portion 144 has, in widened portions 141, 142 at the both ends, a dimension larger than the outer diameter of a tubular material constituting right vertical frame 160 and left vertical frame 170. First plate portion 144 has, in narrowed portion 143 at the central portion, a dimension smaller than the outer diameter of the tubular material constituting right vertical frame 160 and left vertical frame 170.

Figure 8:
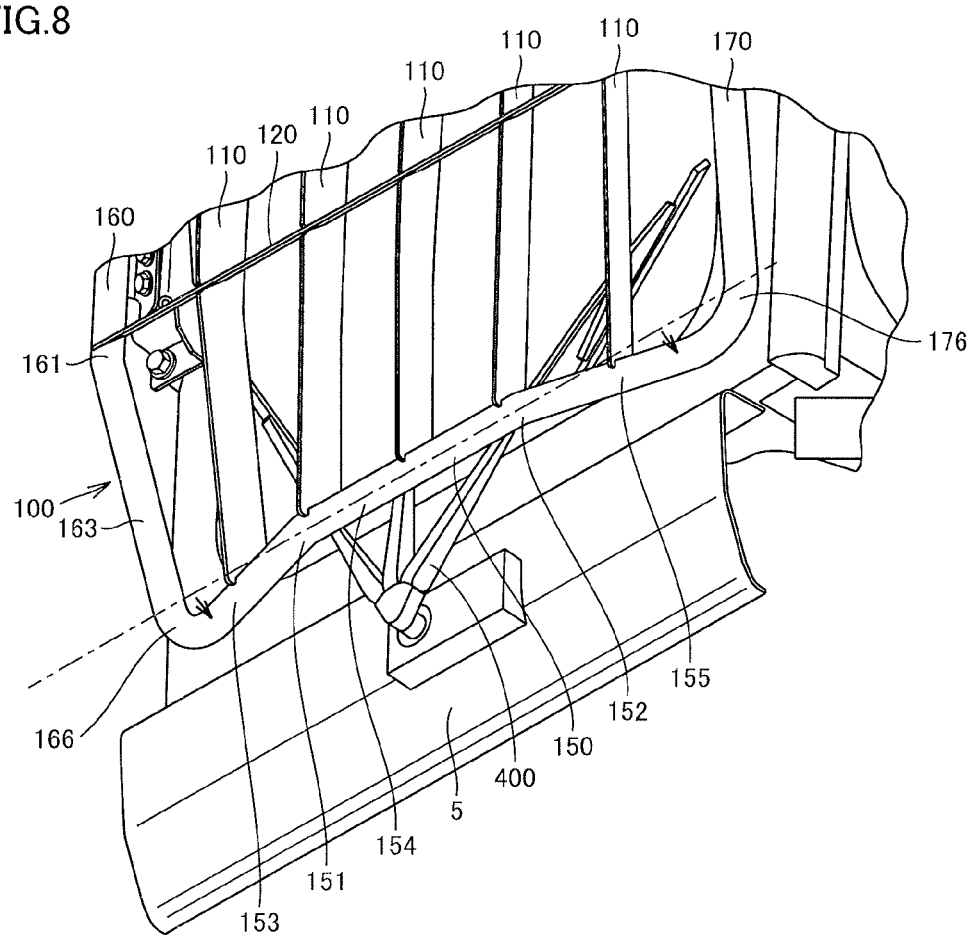
FIG. 8 is a perspective view showing a structure of the guard-equipped cab near a lower frame of the front guard.
Figure 9:
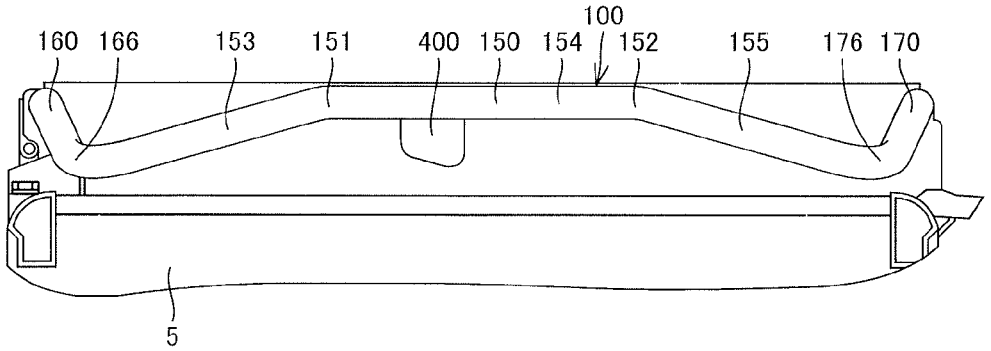
FIG. 9 is a bottom view of a portion of the guard-equipped cab.

FIG. 8 is a perspective view showing a structure of guard-equipped cab 15 near lower frame 150 of front guard 100. FIG. 9 is a bottom view of a portion of guard-equipped cab 15. As shown in FIGS. 8 and 9, lower frame 150 of front guard 100 has a shape bent at lower frame bent portion 151 and lower frame bent portion 152.

Right frame portion 153 of lower frame 150 extends rearward toward cab 5 as it comes close to right vertical frame 160 from lower frame bent portion 151. At lower frame bent portion 151, lower frame 150 is bent in a direction in which the end portion coupled to right vertical frame 160 comes close to cab 5. With guard-equipped cab 15 mounted on revolving frame 10, the end portion of lower frame 150 coupled to right vertical frame 160 is arranged to be closer to the rear side of revolving structure 3 than lower frame bent portion 151.

Left frame portion 155 of lower frame 150 extends rearward toward cab 5 as it comes close to left vertical frame 170 from lower frame bent portion 152. At lower frame bent portion 152, lower frame 150 is bent in a direction in which the end portion coupled to left vertical frame 170 comes close to cab 5. With guard-equipped cab 15 mounted on revolving frame 10, the end portion of lower frame 150 coupled to left vertical frame 170 is arranged to be closer to the rear side of revolving structure 3 than lower frame bent portion 152.

Right frame portion 153 of lower frame 150 and left frame portion 155 of lower frame 150 are bent in the same direction with respect to central frame portion 154. An alternate long and short dash line shown in FIG. 8 indicates a direction in which central frame portion 154 extends, and arrows shown in FIG. 8 indicate directions in which right frame portion 153 and left frame portion 155 are bent with respect to the direction in which central frame portion 154 extends.

Since lower frame 150 has a bent shape, a gap is formed between central frame portion 154 of lower frame 150 and the front surface of cab 5. A wiper 400 for cleaning a front windshield of cab 5 is arranged in this gap. Lower frame 150 has a shape bent at two lower frame bent portions 151, 152, such that wiper 400 can be placed between central frame portion 154 of lower frame 150 and cab 5, and the end portions of lower frame 150 are arranged close to the front surface of cab 5. The both end portions of lower frame 150 are arranged at positions closer to the front surface of cab 5 than central frame portion 154.

Figure 10:
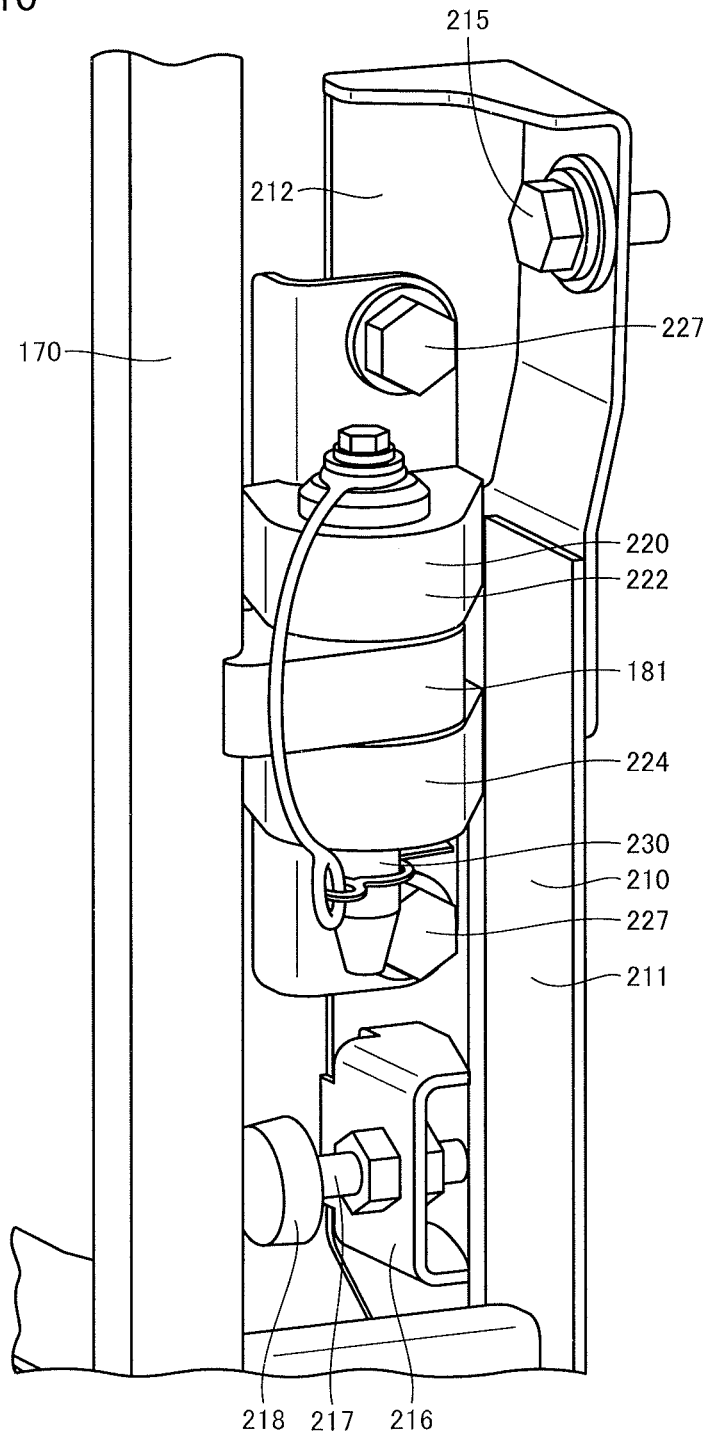
FIG. 10 is a perspective view showing a lock device which locks the front guard to the cab.
Figure 11:
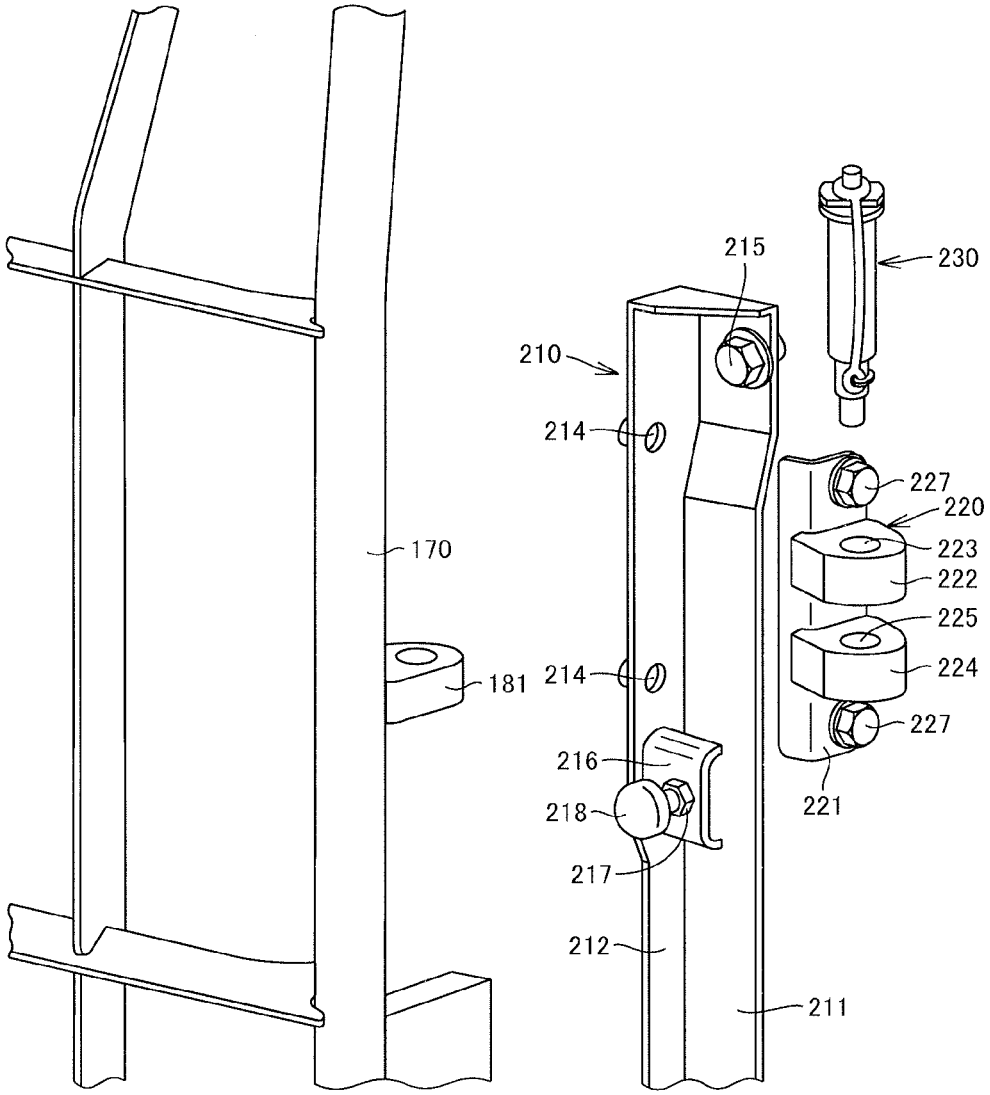
FIG. 11 is an exploded perspective view of the lock device shown in FIG. 10.

FIG. 10 is a perspective view showing the lock device which locks front guard 100 to cab 5. FIG. 11 is an exploded perspective view of the lock device shown in FIG. 10.

As shown in FIGS. 10 and 11, bracket 210 has plate portions 211, 212. Plate portions 211, 212 each have the shape of an elongate plate, and long sides thereof are joined. Plate portions 211, 212 are perpendicular to each other.

Through-holes 214 penetrating plate portion 212 in a thickness direction are formed in plate portion 212. Through-holes not shown are formed in plate portion 211, and bolts 215 are inserted into the through-holes.

A stopper fixing portion 216 is fixed to plate portion 212. A through-hole is formed in stopper fixing portion 216, and a bolt 217 is inserted into the through-hole. A stopper 218 made of rubber is mounted on the head of bolt 217.

Pin stop portion 220 has a body portion 221. Through-holes not shown are formed in body portion 221, and bolts 227, 227 are inserted into the through-holes. Pin stop portion 220 has pin insertion portions 222, 224. A pin insertion hole 223 is formed in pin insertion portion 222. A pin insertion hole 225 is formed in pin insertion portion 224. Pin insertion holes 223, 225 have an inner diameter slightly larger than the outer diameter of pin 230.

Bolts 215 penetrate the through-holes formed in plate portion 211 of bracket 210, and bolts 215 are fixed to the left front pillar of cab 5. Thereby, bracket 210 is fixed to cab 5. Bolts 227 penetrate the through-holes formed in body portion 221 of pin stop portion 220, and bolts 227 also penetrate through-holes 214 formed in plate portion 212 of bracket 210, and thereby pin stop portion 220 is fixed to bracket 210.

When front guard 100 is closed, pin insertion portion 181 provided to front guard 100 is arranged between pin insertion portions 222, 224 formed in pin stop portion 220. By arranging pin 230 to penetrate pin insertion portion 222, pin insertion portion 181, and pin insertion portion 224 in order in this state, pin insertion portion 181 is fixed to pin stop portion 220. Thereby, front guard 100 is assembled to cab 5 with two members, i.e., bracket 210 and pin stop portions 220, interposed therebetween.

In order to allow insertion and removal of pin 230 into and from pin insertion portions 222, 224 and pin insertion portion 181, it is necessary to arrange the rotation axis of hinge portions 320 shown in FIG. 4 to be parallel to the central axis of pin insertion holes 223, 225 formed in pin insertion portions 222, 224 and the pin insertion hole formed in pin insertion portion 181. In order to adjust positions of pin insertion holes 223, 225, it is necessary to adjust the position for fixing pin stop portion 220 to bracket 210.

Accordingly, through-holes 214 formed in bracket 210 in the present embodiment have an inner diameter larger than the outer diameter of bolts 227 inserted into through-holes 214. Thereby, the position for fixing pin stop portion 220 to bracket 210 can be adjusted. In addition, the through-holes into which bolts 215 are inserted are formed as elongated holes extending in a short direction of plate portion 211. With bracket 210 being mounted on cab 5, the elongated holes extend in the left-right direction of cab 5. Thereby, the position for fixing bracket 210 to cab 5 can be adjusted.

Thus, the positions of the pin insertion holes can be adjusted freely and pin 230 can be inserted into the pin insertion holes more reliably, by providing bracket 210 and pin stop portion 220 as separate members, and allowing adjustment of the position for fixing bracket 210 to cab 5 and the position for fixing pin stop portion 220 to bracket 210.

In a state where pin 230 is inserted into the pin insertion holes and front guard 100 is closed as shown in FIG. 10, stopper 218 is in contact with left vertical frame 170 of front guard 100. On this occasion, stopper 218 is elastically deformed, and stress acts on front guard 100 from stopper 218. The pin insertion holes have an inner diameter slightly larger than the outer diameter of pin 230, in order to facilitate insertion of pin 230. Accordingly, rattling of front guard 100 in the state where front guard 100 is closed is suppressed by positioning front guard 100 using stopper 218.

Figure 12:
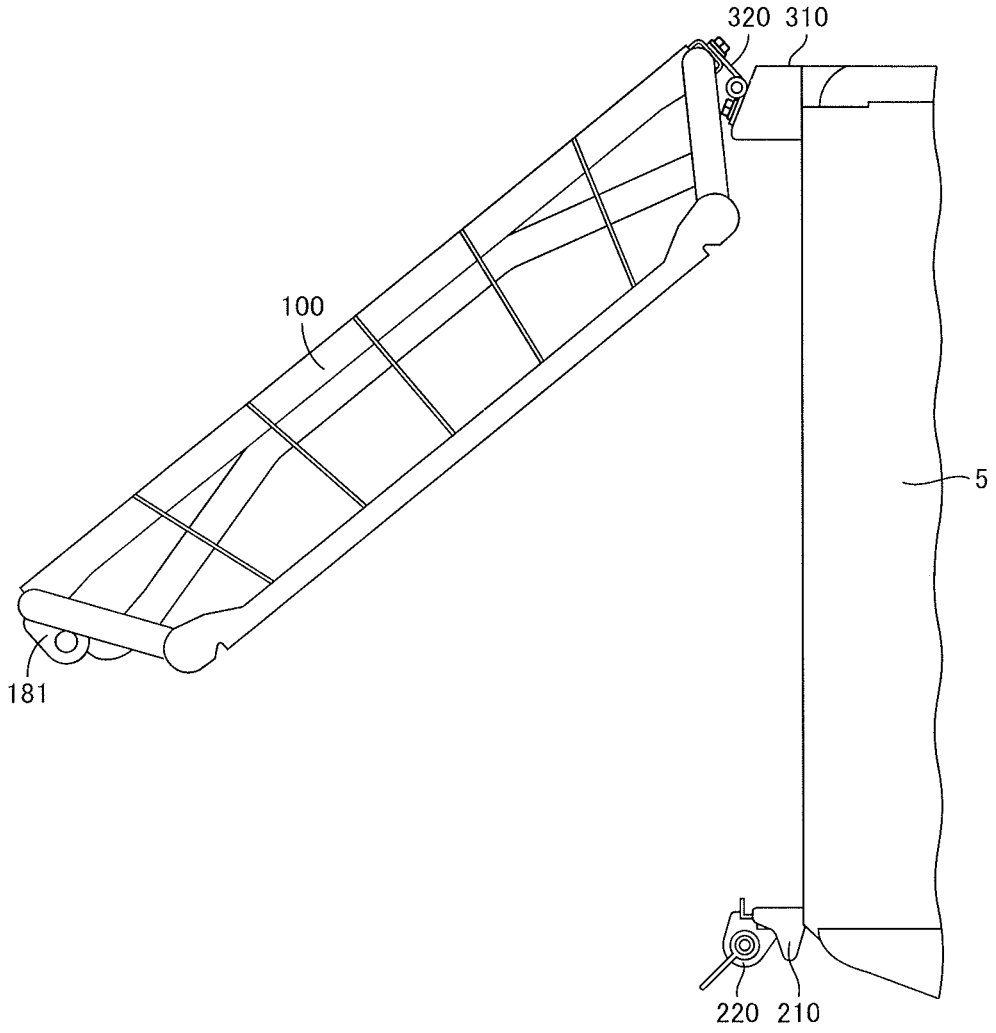
FIG. 12 is a plan view showing the front guard in an opened state with respect to the cab.

FIG. 12 is a plan view showing front guard 100 in an opened state with respect to cab 5. As described above, by removing pins 230 from pin stop portions 220 and pin insertion portions 181, 182, front guard 100 is operable/closeable with respect to the front surface of cab 5, about hinge portions 320. FIG. 12 shows front guard 100 which rotates clockwise as viewed in a plan view with respect to cab 5, about hinge portions 320.

Since front guard 100 is arranged away from the front surface of cab 5, the operator can easily access the front surface of cab 5. The operator can easily perform maintenance work such as cleaning of the front windshield of cab 5, by setting front guard 100 in an opened state. Ease of maintenance of cab 5 is improved by forming front guard 100 to be openable/closable.

(Second Embodiment)

Figure 13:
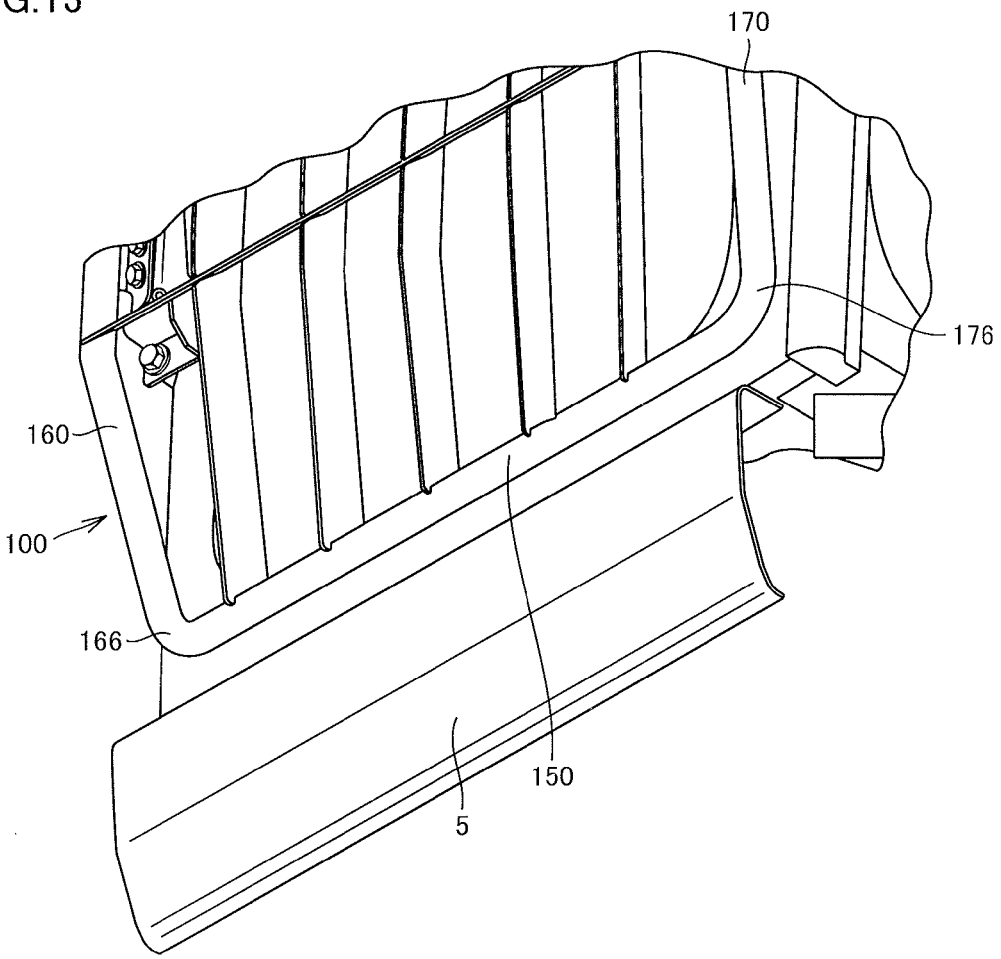
FIG. 13 is a perspective view showing a structure of a guard-equipped cab in a second embodiment, near a lower frame of a front guard.
Figure 14:
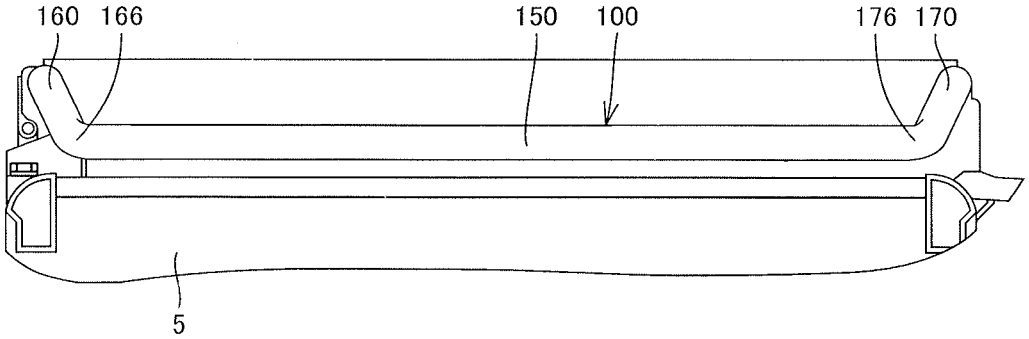
FIG. 14 is a bottom view of a portion of the guard-equipped cab in the second embodiment.

FIG. 13 is a perspective view showing a structure of guard-equipped cab 15 in a second embodiment, near lower frame 150 of front guard 100. FIG. 14 is a bottom view of a portion of guard-equipped cab 15 in the second embodiment.

Guard-equipped cab 15 in the second embodiment is different from that in the first embodiment in that it does not have wiper 400 shown in FIGS. 8 and 9. Since no wiper 400 is provided, there is no need to form a space for housing wiper 400 between lower frame 150 of front guard 100 and the front surface of cab 5. Accordingly, lower frame 150 in the second embodiment is formed in the shape of a straight tube. Lower frame 150 in the second embodiment does not have a lower frame bent portion, and extends in the left-right direction along the front surface of cab 5.

When compared with lower frame 150 in the first embodiment, lower frame 150 in the second embodiment is arranged, as a whole, to be closer to the front surface of cab 5. When compared with the first embodiment, the spacing between lower frame 150 and the front surface of cab 5 is smaller in the second embodiment.

The configuration and the function and effect of the work vehicle including guard-equipped cab 15 in the embodiments described above will be summarized as described below.

According to the embodiments described above, as shown in FIG. 1, work implement 4 of hydraulic excavator 1 is arranged on the right side of cab 5.

As shown in FIGS. 2 to 4, front guard 100 provided on the front side of cab 5 has frame 130. Frame 130 constitutes the outer edge of front guard 100. Frame 130 has upper frame 140, lower frame 150, right vertical frame 160, and left vertical frame 170. Frame 130 is formed by framing upper frame 140, lower frame 150, right vertical frame 160, and left vertical frame 170. Right vertical frame 160 has vertical frame bent portion 161. Right vertical frame 160 extends rearward toward cab 5 as it comes close to lower frame 150 from vertical frame bent portion 161.

Concerning the visibility from cab 5 of hydraulic excavator 1, the visibility in the lower right direction in which work implement 4 performs work with high frequency is most important. In a conventional front guard, a frame constituting an outer edge of the front guard obstructs a field of vision of an operator. Accordingly, the field of vision from an operator seat inside a cab cannot be fully obtained.

Thus, of a pair of vertical frames of frame 130, right vertical frame 160 closer to work implement 4 is bent, and a lower portion of right vertical frame 160 is arranged to be close to cab 5. Thereby, frame 130 is less likely to obstruct the field of vision in the lower right direction of the operator sitting inside cab 5. Therefore, the field of vision of the operator from inside cab 5 equipped with front guard 100 can be expanded.

As a result of improved visibility, the operator sitting inside cab 5 can see bucket 4*c* more easily, and can readily check the state of work such as road surface excavation by work implement 4. Therefore, workability of hydraulic excavator 1 can be improved.

As shown in FIGS. 2 to 4, left vertical frame 170 of frame 130 also has vertical frame bent portion 171. Left vertical frame 170 extends rearward toward cab 5 as it comes close to the lower frame from vertical frame bent portion 171. By bending left vertical frame 170 and arranging a lower portion of left vertical frame 170 to be close to cab 5, frame 130 is less likely to obstruct the field of vision in the lower left direction of the operator sitting inside cab 5. Accordingly, the field of vision of the operator from inside cab 5 equipped with front guard 100 is further expanded.

Hydraulic excavator 1 may be provided with a blade in front of crawler belts 2*a*, in addition to work implement 4. By expanding the field of vision of the operator sitting inside cab 5 in the lower left direction in addition to the lower right direction, the operator can see the blade more easily, and can readily check the state of work by the blade. Therefore, workability of hydraulic excavator 1 can be further improved.

Further, as shown in FIGS. 5 to 7, upper frame 140 of frame 130 is formed of a plate material. Thereby, when compared with a conventional frame in which an upper frame portion of a frame body is formed of a tubular material, upper frame 140 is less visible from the operator sitting inside cab 5, and upper frame 140 is less likely to obstruct the operator's field of vision in the upward direction. Therefore, the field of vision of the operator from inside cab 5 equipped with front guard 100 can be further expanded.

Figure 15:
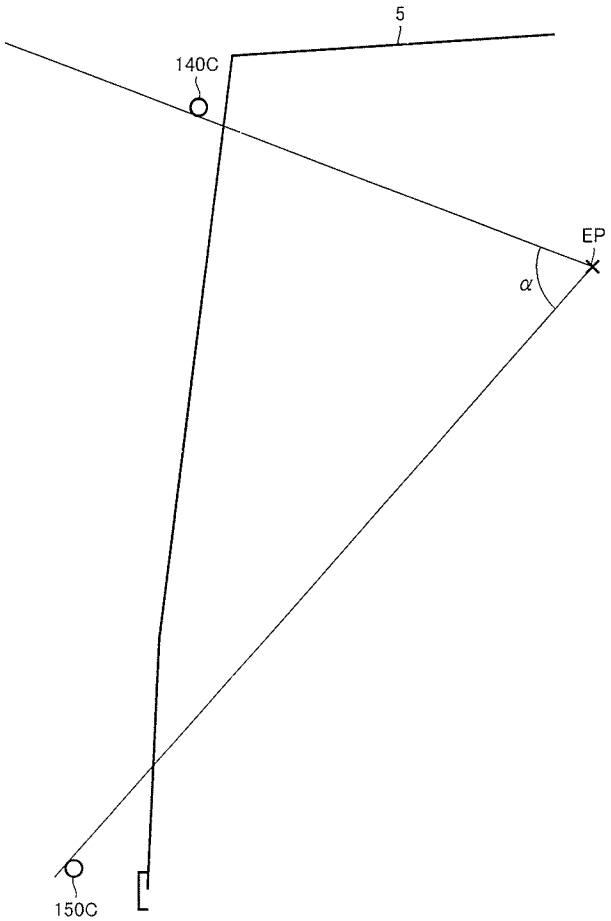
FIG. 15 shows schematic views each showing a field of vision from inside a cab in a guard-equipped cab.
Figure 15:
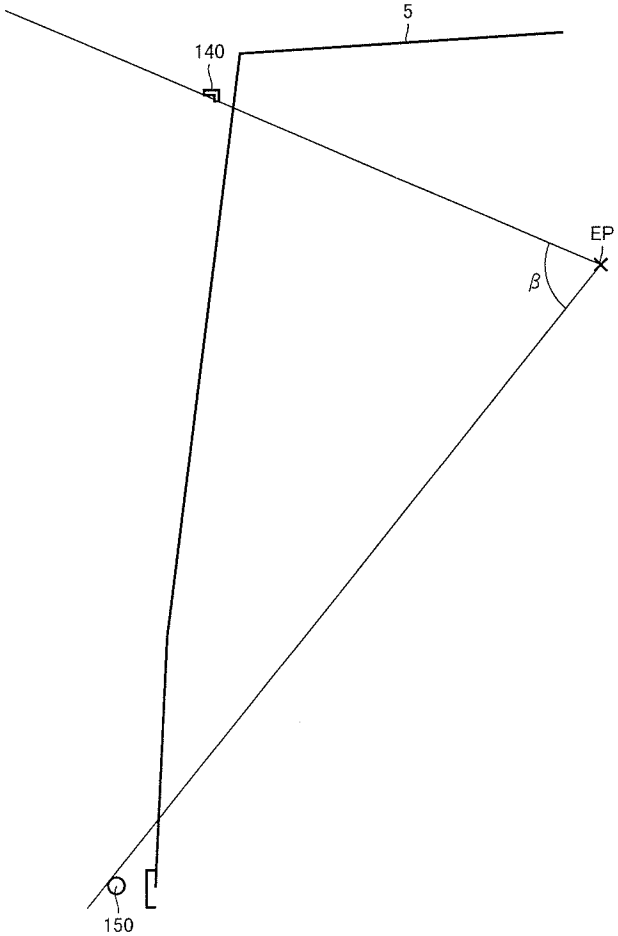

FIG. 15 shows schematic views each showing the field of vision from inside cab 5 in the guard-equipped cab. FIG. 15(*a*) is a schematic view showing the field of vision from inside cab 5 in a conventional guard-equipped cab. As shown in FIG. 15(*a*), the conventional guard-equipped cab has a tubular upper frame 140C and a tubular lower frame 150C. In the conventional guard-equipped cab, the field of vision in the vertical direction of the operator sitting inside cab 5, about an eye point EP of the operator, has an angle $\alpha$.

FIG. 15(*b*) is a schematic view showing the field of vision from inside cab 5 in guard-equipped cab 15 in the embodiments. As shown in FIG. 15(*b*), guard-equipped cab 15 in the embodiments has upper frame 140 formed of a plate material and tubular lower frame 150. When compared with FIG. 15(*a*), the entire front guard 100 is arranged to be close to cab 5, and lower frame 150 is arranged to be closer to cab 5 as it is bent. In guard-equipped cab 15 in the embodiments, the field of vision in the vertical direction of the operator sitting inside cab 5, about eye point EP of the operator, has an angle $\beta$.

When comparison is made between FIG. 15(*a*) and FIG. 15(*b*), angle $\beta$ of the field of vision in the embodiments is larger than angle $\alpha$ of the field of vision in the conventional case. For example, angle $\beta$ of the field of vision is 8% larger than angle $\alpha$ of the field of vision. Therefore, it is proved that front guard 100 of the embodiments can expand the field of vision of the operator from inside cab 5 equipped with front guard 100.

Further, as shown in FIGS. 5 to 7, upper frame 140 of frame 130 has widened portions 141, 142 at the both ends, and has narrowed portion 143 narrower than widened portions 141, 142 at the central portion. When comparison is made between widened portions 141, 142 and narrowed portion 143, widened portions 141, 142 are formed to be relatively wide, and narrowed portion 143 is formed to be relatively narrow.

Thereby, upper end portion 167 of right vertical frame 160 can be welded to widened portion 141, and upper end portion 177 of left vertical frame 170 can be welded to widened portion 142. The frame body is formed by fixing right vertical frame 160 and left vertical frame 170 to widened portions 141, 142, respectively, at the both ends of upper frame 140. Therefore, the productivity of frame 130 can be improved, and the strength of frame 130 can be ensured.

By forming narrowed portion 143 at the center portion to be narrower than widened portions 141, 142 at the both ends, narrowed portion 143 is further less likely to obstruct the operator's field of vision in the upward direction. Therefore, the field of vision of the operator from inside cab 5 equipped with front guard 100 can be further expanded.

Since upper frame 140 is arranged at a position away from the operator sitting inside cab 5, the strength required for front guard 100 can be fully ensured even though upper frame 140 is formed of a plate material instead of a tubular material. Since the strength of upper frame 140 can be further improved by constructing upper frame 140 to have a shape formed by bending an elongate plate material along a longitudinal direction as shown in FIG. 7, the strength of front guard 100 can be reliably ensured.

Further, as shown in FIGS. 2 to 4, lower frame 150, right vertical frame 160, and left vertical frame 170 are formed of a pipe. By forming lower frame 150, right vertical frame 160, and left vertical frame 170 of a pipe, front guard 100 which fully ensures the required strength can be easily achieved even though upper frame 140 is formed of a plate material.

Further, as shown in FIG. 4, right vertical frame 160 is provided with a plurality of bolt attachment portions 168. Bolt attachment portion 168 constitutes a mounting portion which mounts front guard 100 on cab 5, together with hinge portion 320 and bracket 310. Right vertical frame 160 has lower end portion 166 coupled to lower frame 150. Vertical frame bent portion 161 is formed at a position closer to lower end portion 166 than lower bolt attachment portion 168 of two bolt attachment portions 168.

Thereby, a space for arranging the mounting portions can be fully ensured between central frame portion 164 provided with bolt attachment portions 168 and the front surface of cab 5. By bending a portion of right vertical frame 160 which is not required to ensure the space for arranging the mounting portions, and arranging the portion to be close to cab 5, the field of vision of the operator from inside cab 5 can be expanded.

Further, as shown in FIG. 4, the mounting portions which mount front guard 100 on cab 5 each have hinge portion 320. As shown in FIG. 12, front guard 100 relatively rotates with respect to the cab, about hinge portions 320. Since front guard 100 can be thereby easily opened and closed, maintainability of guard-equipped cab 15 such as cleaning of the front windshield of cab 5 can be improved.

Right vertical frame 160 of frame 130 is provided with the mounting portions having hinge portions 320, whereas left vertical frame 170 of frame 130 is provided with the lock devices which lock front guard 100 in a closed state, as shown in FIGS. 10 and 11.

As shown in FIG. 3, left vertical frame 170 is provided with a plurality of pin insertion portions 181, 182. Pin insertion portion 181, 182 constitutes a lock device, together with pin stop portion 220 and bracket 210. Left vertical frame 170 has lower end portion 176 coupled to lower frame 150. Vertical frame bent portion 171 is formed at a position closer to lower end portion 176 than lower pin insertion portion 182 of two pin insertion portions 181, 182.

Thereby, a space for arranging the lock devices can be fully ensured between central frame portion 174 provided with pin insertion portions 181, 182 and the front surface of cab 5. By bending a portion of left vertical frame 170 which is not required to ensure the space for arranging the lock devices, and arranging the portion to be close to cab 5, the field of vision of the operator from inside cab 5 can be expanded.

Locking and unlocking of front guard 100 with respect to cab 5 are switched in left vertical frame 170 which is farther from work implement 4, of the pair of vertical frames of frame 130. As shown in FIG. 1, when compared with right vertical frame 160, left vertical frame 170 is arranged at a position closer to a side edge of revolving frame 10. Accordingly, if it is configured that locking and unlocking of front guard 100 are switched in left vertical frame 170, locking work and unlocking work can be performed more easily.

When the operator sets front guard 100 in an opened state and cleans the front windshield of cab 5, the operator performs work, riding on crawler belt 2*a*. Accordingly, if it is configured that front guard 100 rotates about hinge portions 320 provided to right vertical frame 160, front guard 100 in an opened state does not obstruct the operator's work, and workability can be further improved.

Further, as shown in FIGS. 8 and 9, lower frame 150 of front guard 100 has lower frame bent portion 151. Lower frame 150 extends rearward toward cab 5 as it comes close to right vertical frame 160 from lower frame bent portion 151.

Thereby, a space for arranging wiper 400 can be fully ensured between central frame portion 154 of the lower frame 150 and the front surface of cab 5. By bending a portion of lower frame 150 which is not required to ensure the space for arranging wiper 400, and arranging the portion to be close to cab 5, the field of vision of the operator from inside cab 5 can be expanded.

On the other hand, when guard-equipped cab 15 is not provided with a wiper, lower frame 150 can be formed in the shape of a straight tube without forming a lower frame bent portion in lower frame 150, as shown in FIGS. 13 and 14. Since the entire lower frame 150 can be thereby arranged to be close to cab 5, the field of vision of the operator from inside cab 5 can be further expanded.

It is noted that the embodiments described above have described front guard 100 in which a grid is formed by the plurality of first plate members 110 and the plurality of second plate members 120, and frame 130 surrounds the grid. Front guard 100 in the embodiments has a high strength, and can satisfy the acceptable standard of level II, of the performance requirements for evaluating characteristics of an operator protective guard defined by ISO (International Organization for Standardization) 10262. Front guard 100 is not limited to this configuration, and the features concerning frame 130 described above may be applied to an operator protective guard which satisfies the acceptable standard of level I defined by ISO 10262. For example, an operator protective guard may be constructed by assembling a screen body to the frame described above.

Further, the embodiments described above have described the example where work implement 4 is arranged on the right side of guard-equipped cab 15 arranged on the front left side of revolving structure 3 as shown in FIG. 1. The arrangement of guard-equipped cab 15 and work implement 4 is not limited to the example shown in FIG. 1, and work implement 4 may be provided on the left side of guard-equipped cab 15 arranged on the front right side of revolving structure 3. In this case, the effect that the operator can see bucket 4*c* more easily from inside cab 5 can be similarly obtained, since left vertical frame 170 closer to work implement 4, of the pair of vertical frames of frame 130, extends rearward toward cab 5 as it comes close to lower frame 150 from vertical frame bent portion 171.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

REFERENCE SIGNS LIST

1: hydraulic excavator; 2: travel structure; 2*a*: crawler belt; 3: revolving structure; 4: work implement; 4*a*: boom; 4*b*: arm; 4*c*: bucket; 5: cab; 10: revolving frame; 15: guard-equipped cab; 100: front guard; 110: first plate member; 120: second plate member; 130: frame; 140: upper frame; 141, 142: widened portion; 143: narrowed portion; 144: first plate portion; 145: second plate portion; 146: protrusion; 147: slit; 148: bent portion; 150: lower frame; 151, 152: lower frame bent portion; 153: right frame portion; 154, 164, 174: central frame portion; 155: left frame portion; 160: right vertical frame; 161, 162, 171, 172: vertical frame bent portion; 163, 173: lower frame portion; 165, 175: upper frame portion; 166, 176: lower end portion; 167, 177: upper end portion; 168: bolt attachment portion; 170: left vertical frame; 181, 182, 222, 224: pin insertion portion; 210, 310: bracket; 211, 212: plate portion; 214: through-hole; 215, 217, 227: bolt; 216: stopper fixing portion; 218: stopper; 220: pin stop portion; 221: body portion; 222, 224: pin insertion portion; 223, 225: pin insertion hole; 230: pin; 320: hinge portion; 400: wiper; EP: eye point.

The invention claimed is:

1. A work vehicle, comprising:

a work implement;

a cab arranged on a lateral side of said work implement; and an operator protective guard provided on a front side of said cab, said operator protective guard including a frame body constituting an outer edge of said operator protective guard, said frame body including an upper frame, a lower frame, a right vertical frame, and a left vertical frame, and being formed by framing said upper frame, said lower frame, said right vertical frame, and said left vertical frame, and one of said right vertical frame and said left vertical frame which is closer to said work implement including a vertical frame bent portion, and extending rearward toward said cab as said one vertical frame comes close to said lower frame from said vertical frame bent portion, said one vertical frame is provided with a plurality of mounting portions mounting said operator protective guard on said cab, said one vertical frame includes a lower end portion coupled to said lower frame, and said vertical frame bent portion is formed at a position closer to said lower end portion than a lowermost one of said mounting portions.

2. The work vehicle according to claim 1, wherein said upper frame is formed of a plate material.

3. The work vehicle according to claim 2, wherein said upper frame includes widened portions at both ends, and includes a narrowed portion narrower than said widened portions at a central portion.

4. The work vehicle according to claim 2, wherein said lower frame, said right vertical frame, and said left vertical frame are formed of a pipe.

5. The work vehicle according to claim 1, wherein said mounting portions each include a hinge structure, and said operator protective guard relatively rotates with respect to said cab, about said hinge structures.

6. The work vehicle according to claim 1, wherein said lower frame includes a lower frame bent portion, and extends rearward toward said cab as said lower frame comes close to said one vertical frame from said lower frame bent portion.

7. An operator protective guard provided on a front side of a cab of a work machine, comprising:

a frame body constituting an outer edge of said operator protective guard, said frame body including an upper frame formed of a plate material, a lower frame formed of a pipe, and a right vertical frame and a left vertical frame which are formed of a pipe and at least one of which includes a vertical frame bent portion, one of said right vertical frame and said left vertical frame including said vertical frame bent portion is provided with a plurality of mounting portions mounting said operator protective guard on said cab, said one vertical frame includes a lower end portion coupled to said lower frame, and said vertical frame bent portion is formed at a position closer to said lower end portion than a lowermost one of said mounting portions.

* * * * *